US011719503B2

(12) United States Patent
Salomon

(10) Patent No.: US 11,719,503 B2
(45) Date of Patent: Aug. 8, 2023

(54) FIREARM TRAINING SYSTEM AND METHOD UTILIZING DISTRIBUTED STIMULUS PROJECTION

(71) Applicant: INNOVATIVE SERVICES AND SOLUTIONS LLC, Silver Point, TN (US)

(72) Inventor: Dustin Salomon, Silver Point, TN (US)

(73) Assignee: Innovative Services and Solutions LLC, Silver Point, TN (US)

( * ) Notice: Subject to any disclaimer, the term of this patent is extended or adjusted under 35 U.S.C. 154(b) by 249 days.

(21) Appl. No.: 16/885,735

(22) Filed: May 28, 2020

(65) Prior Publication Data

US 2021/0231401 A1 Jul. 29, 2021

Related U.S. Application Data

(60) Provisional application No. 62/965,575, filed on Jan. 24, 2020.

(51) Int. Cl.

| | |
|---|---|
| ***F41A 33/02*** | (2006.01) |
| ***F41A 33/04*** | (2006.01) |
| ***F41J 5/02*** | (2006.01) |

(52) U.S. Cl.

CPC ..... *F41A 33/02* (2013.01); *F41A 33/04* (2013.01); *F41J 5/02* (2013.01)

(58) Field of Classification Search

CPC .... F41A 33/02; F41A 33/04; F41J 5/02; F41J 9/14; F41G 3/2694

(Continued)

(56) References Cited

U.S. PATENT DOCUMENTS 3,889,396 A * 6/1975 Aronson ..... F41G 3/2627 434/21
4,276,028 A * 6/1981 Gwynn ..... F41J 9/14 434/20

(Continued)

FOREIGN PATENT DOCUMENTS

EP 1218687 A1 7/2002
WO WO-0125716 A1 * 4/2001 ..... F41A 33/02

(Continued)

OTHER PUBLICATIONS

Search Report for corresponding application No. PCT/US2020/034810, dated Dec. 16, 2020, 12 pages.

(Continued)

*Primary Examiner* — Robert P Bullington
*Assistant Examiner* — Stephen Alvesteffer
(74) *Attorney, Agent, or Firm* — Patterson Intellectual Property Law, PC; Gary L. Montle

(57) ABSTRACT

Systems and methods are disclosed herein to improve efficiency and effectiveness in firearms and tactical training, at least in part by selectively generating images onto external target elements. One or more portable devices are selectively mounted with respect to selected ones of the external target elements, which may be fixed in position or mobile as the application demands. Each device includes a housing accommodating and configured for optical projection of light from an array of laser sources and diffractive optical elements. A device controller directs the projection of light from one or more of the laser sources according to a programmed target stimulus arrangement. The device controller may be individually and manually programmed or commanded in some embodiments, but alternatively a master controller may be implemented to coordinate light projections from an array of devices to provide any number of (Continued)

desired scenarios for neurological and/or physiological stimulation of users.

9 Claims, 7 Drawing Sheets

(58) Field of Classification Search
USPC ..... 434/21
See application file for complete search history.

(56) References Cited

U.S. PATENT DOCUMENTS

| | | | | |
|---|---|---|---|---|
| 4,392,652 | A * | 7/1983 | Knight | F41J 11/00 273/408 |
| 5,194,007 | A | 3/1993 | Marshall et al. | |
| 5,577,733 | A | 11/1996 | Downing | |
| 7,826,069 | B2 | 11/2010 | Rueb et al. | |
| 9,733,048 | B2 | 8/2017 | Hu | |
| 2009/0217565 | A1* | 9/2009 | Ford | F41A 17/08 42/114 |
| 2014/0134574 | A1* | 5/2014 | Yach | F41A 33/02 434/22 |
| 2014/0248587 | A1* | 9/2014 | Gordon | F41J 7/06 434/21 |
| 2016/0138895 | A1* | 5/2016 | Beine | F41J 5/10 434/19 |
| 2016/0245624 | A1 | 8/2016 | Haasnoot et al. | |
| 2016/0258721 | A1* | 9/2016 | Davis | F41J 2/00 |
| 2016/0298930 | A1* | 10/2016 | Squire | F41G 3/2655 |
| 2017/0275530 | A1* | 9/2017 | Buckley | C09K 11/02 |
| 2018/0213179 | A1* | 7/2018 | Martin | G11B 27/19 |
| 2019/0383585 | A1* | 12/2019 | Boring | F41J 5/24 |

FOREIGN PATENT DOCUMENTS

| | | | |
|---|---|---|---|
| WO | 2001/94872 | A2 | 12/2001 |
| WO | 2012126690 | A1 | 9/2012 |

OTHER PUBLICATIONS

Khan, Md Abdullah Al Hafiz & Welsh, David & Roy, Nirmalya. (2018). Firearm Detection Using Wrist Worn Tri-Axis Accelerometer Signals. 221-226. 10.1109/PERCOMW.2018.8480345.

* cited by examiner

FIREARM TRAINING SYSTEM AND METHOD UTILIZING DISTRIBUTED STIMULUS PROJECTION

CROSS-REFERENCES TO RELATED APPLICATIONS

This application claims benefit of U.S. Provisional Patent Application No. 62/965,575, filed Jan. 24, 2020, and which is hereby incorporated by reference in its entirety.

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

BACKGROUND

The present invention relates generally to firearm training systems and methods. More particularly, an embodiment of an invention as disclosed herein relates to devices which can be implemented alone or in configurable groups to project images for scenario generation with respect to firearm targets.

One of skill in the art will readily appreciate that the specific requirements during events which require the application of clinical use-of-force skills (including deadly force and the use of firearms) can change based on an almost unlimited number of variables. These range from terrain features and numbers of adversaries to the actions of non-involved bystanders and the types of tools available to the people involved. However, the neurological processes involved in the lead-up to, application of, and aftermath of use-of-force incidents are relatively consistent and therefore also predictable with a degree of accuracy that reasonably facilitates the design of supportive training technologies and methods.

Accordingly, certain brain functions may generally encompass many, if not most, applications of force, including but not limited to lethal force. Outlier situations undoubtedly occur, but a desirable or even primary objective within the context of developing training systems as disclosed herein may be developing the neurological and physical functions that are predictably required during real-world clinical skill performance.

Numerous training objectives, methods and technologies are presently in existence, including for example video-based simulators, the use of shot-timers during both live-fire and dry-fire training, the use of audible stimuli to define what targets a student should engage during a training evolution, the use of turning targets, and force-on-force training, among others. Each of these examples have their own capabilities, but also can have limited or even negative effects when either used improperly or when used exclusively as a training method, and none of the training and qualification methods commonly used in the firearms industry today are capable of functionally engaging the same neurological and physiological mechanisms required during a real-world application of deadly force within the parameters necessary for effective operational performance development.

For example, one limitation common to most existing training systems, even those that facilitate the presence of dynamic, reactive stimuli, is that they are limited in their ability to exercise or require situational awareness on the part of the trainee. In most cases, facility and/or equipment restraints limit the stimuli presented to a single direction (downrange or otherwise in a predetermined direction where a screen or other projection surface is present). Most training systems and methods today (with the notable exception of force-on-force training) accordingly fail with respect to their ability to provide a spatial awareness component to scene layout, context, and situational awareness. Even very advanced, expensive simulators that facilitate multi-directional environments and response to dynamic stimuli in these settings do not possess the capacity, at a neurological level, of establishing the foundational spatial components of situational awareness.

One of skill in the art may appreciate that while a necessary and justified decision to apply any level of force, including deadly force, is typically cumulative, it is almost always a visual stimulus upon which the decision to "flip the switch" hinges. In most use-of-force paradigms a decision to apply deadly force relates directly to imminent danger of death or serious bodily harm. A threat alone is insufficient, as is a theoretical or future potential for danger. It must be real and imminent danger. Before someone can be aware that this is the case (at least outside of very close contact ranges), a visual stimulus will almost always be both involved and the single deciding factor that may be referred to further herein as the "determinative stimulus." The determinative stimulus which leads to the decision to apply deadly force will typically involve two distinctive visual system input and processing systems, namely, object recognition and motion detection.

The fundamentals of connectionist, cognitive-infrastructure-based learning theory indicate that development and improvement (i.e., learning) occurs most effectively and (just as importantly in an engineered training context) most predictably and controllably, through repetitive use of the relevant neural circuitry. Therefore, at a systems level, preparing for (learning for) a use-of-force encounter is, neurologically, a matter of creating an efficient brain map that corresponds to the brain map requirements of the encounter itself. This capacity, then, should be considered one of the most significant factors relevant to a training system's ability to prepare students for successful operational outcomes.

The training tools and methods that are in predominant use throughout the training industry are either incapable of activating the full brain map relevant to deadly force encounters or make it impractical for any one student to reasonably perform the number of repetitions over time necessary to functionally develop the applicable brain map(s) for successful critical incident performance. Because of this, preparing students for successful outcomes is extraordinarily difficult. It is also rarely predictable or consistent in terms of results, at least outside of high-attrition, high-resource training environments such as those involved in the selection and training for elite units.

Accordingly, it would be desirable to provide an accessible, cost-effective, and scalable tool for the firearms and tactical training industry that does facilitate high-repetition stimulation of, use of, development of, and enhancement of the relevant brain maps for use-of-force encounters.

Another significant limitation with respect to existing training tools and settings, including many applications of force-on-force training, is the limited or non-existent options for personal mobility by the user. Even in the most advanced, and expensive, video simulators that produce 360-degree environments and three-dimensional video or graphics, visuals are still projected on flat, immobile surfaces. Nevertheless, in many real-world tactical environments, terrain and situation-based mobility before, during, and after application of force has the potential to be one of the most, if not the most, important and consequential factor related to a successful outcome.

Accordingly, it would further be desirable to provide a system with the capacity to develop a user's ability to move and maneuver to take advantage of environment and terrain.

BRIEF SUMMARY

An exemplary system as disclosed herein uses low-powered lasers and diffractive optical elements (DOE's) to project simple images onto existing targetry systems (e.g., cardboard or steel) within already existing training environments, theoretically producing at least the minimal stimulation required to activate the relevant components of the human visual system, including both the object recognition and motion detection neural circuitry. In practice, the systems and methods may implement a minimal visual stimulus to activate motion detection and object recognition circuitry and processing, the ability to stimulate contextual, declarative memory (cognitive), and decision-making processing centers, the ability to generate dynamic stimuli that allow flowing up and down use of force levels, and indoor/outdoor, all-weather capability. Exemplary systems and methods as disclosed herein may be used on a shooting range, not just in special rooms or on special lanes.

This capability may be packaged in a device (alone or as networked in an array of, e.g., up to 100 devices) that can be easily deployed to create dynamic, 360-degree, three-dimensional extended reality training environments. This, in turn, facilitates the creation of dynamic scenes and contexts around which decisions can be made and resulting tactical action taken in response to specific stimuli.

The relative minimalism of the disclosed projections allows the visual stimuli to be both determinative and deterministic. The presence or disappearance of a visual stimulus can be precisely established in a forensic timeline. When combined with shooter analysis and performance tracking tools, e.g., integrating an audio input on the device itself like a shot timer and an optional sensor array (audio input and accelerometer for dual inputs/fewer false positives) that may be wrist or weapon mounted, system users may be enabled to measure shooter responses and performance in heretofore unknown ways. Further, information processing and decision-making times may subsequently be included in performance measurement and qualification.

Another advantage of the aforementioned features is the potential ability to measure the time to de-escalation of application of deadly force (and train people to do it). In other words, systems and methods as disclosed herein may be configured such that every use of force (or other application of a clinical tactical skill) requires not only a decision to perform the skill based on evaluation of context and dynamic stimuli, it also requires a decision to de-escalate force, or stop performing the skill, based on the continued dynamics of the presented stimuli and context.

The minimalist approach also provides a technological advantage due to the relatively small information transmission requirements. Unlike video, for example, each recorded and transmitted event in various systems and methods as disclosed herein may be limited to "on/off", "timestamp", "device ID", and the like, wherein a great deal of complexity may be available in concert with a very low data signature. Accordingly, the emphasis is on extended reality rather than virtual reality or augmented reality in order to facilitate easy, low-resource inclusion of critical real-world factors.

In addition, while video projection is limited to flat screens in dimly lit areas, minimalist projection methods as disclosed herein can work effectively outdoors and in daylight environments (although direct sunlight is still a performance-limiting factor when using commercially viable, FDA-compliant lasers), as well as on three-dimensional objects and surfaces covered by multi-colored scenery, clothing, accessories, and the like.

In an embodiment, an exemplary firearm training system as disclosed herein may be implemented for selectively generating images onto external target elements. One or more portable devices are selectively mounted with respect to selected ones of the external target elements. Each device comprises a housing accommodating and configured for optical projection of light from one or more laser sources and one or more diffractive optical elements, and a device controller which directs the projection of light from one or more of the one or more laser sources according to a programmed target stimulus arrangement.

In an exemplary aspect of the above-referenced embodiment, the system may further include a master controller communicatively linked to the one or more portable devices, and configured to transmit the target stimulus arrangement thereto.

In another exemplary aspect of the above-referenced embodiment, a plurality of portable devices defines an array, with each of the portable devices identified as a component of the programmed target stimulus arrangement and configured to direct the projection of light accordingly.

In another exemplary aspect of the above-referenced embodiment, the master controller may selectively link to one or more of a plurality of portable devices associated with a defined target area, and further selectively transmit the target stimulus arrangement to the linked portable devices.

In another exemplary aspect of the above-referenced embodiment, the master controller is responsive to user selection of a target projection setting having one or more required projection components to link to one or more of the plurality of available portable devices in association with the target projection setting.

In another exemplary aspect of the above-referenced embodiment, the master controller identifies an available one or more of the plurality of portable devices, and further selects one or more of the available one or more portable devices based at least in part on required projection components of the target stimulus arrangement.

In another exemplary aspect of the above-referenced embodiment, the one or more portable devices further comprise one or more audio outputs (e.g., buzzers, sirens, chirps), and the respective device controllers direct the projection of light from one or more of the one or more laser sources and of audible signals from the audio outputs according to the programmed target stimulus arrangement. The portable devices may further comprise one or more sensors each having a microphone and an accelerometer and communicatively linked to the master controller, wherein the master controller determines user performance at least partially by correlating audio outputs and optically projected light according to the programmed target stimulus arrangement with audio inputs corresponding to a particular firearm.

In another exemplary aspect of the above-referenced embodiment, the master controller may dynamically modify the programmed target stimulus arrangement upon comparing the determined user performance with one or more target parameters associated with the user performance.

In another exemplary aspect of the above-referenced embodiment, the master controller may comprise a user interface which displays indicia corresponding to the determined user performance, and further enables user selection of one or more modifications to the programmed target stimulus arrangement based on the determined user performance.

DETAILED DESCRIPTION

Figure 1:
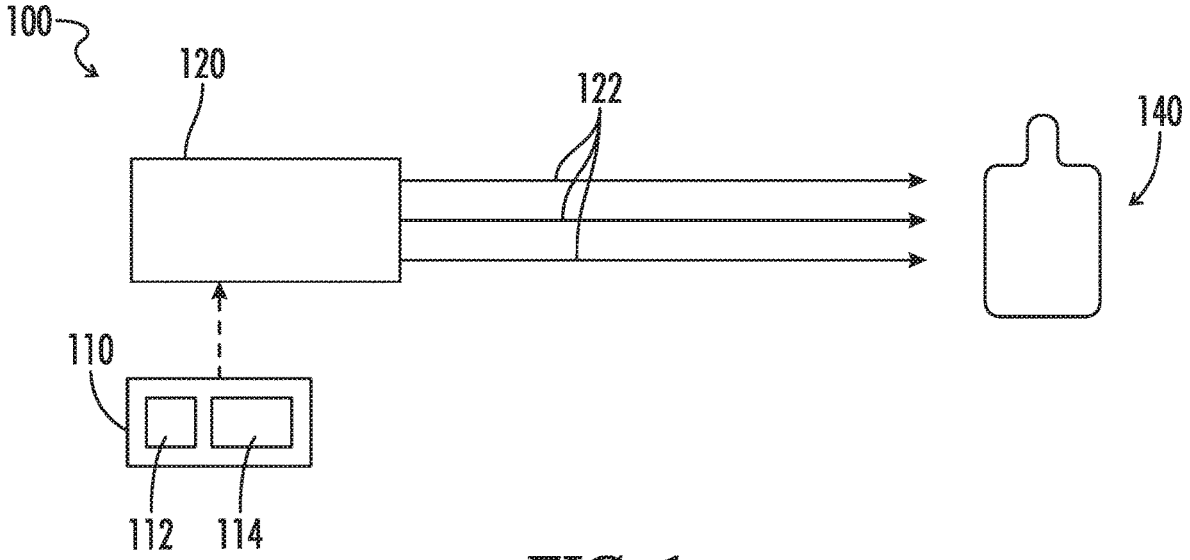
FIG. 1 is a diagram representing an exemplary embodiment of a system as disclosed herein.

Referring generally to FIGS. 1-11, various exemplary embodiments of an invention may now be described in detail. Where the various figures may describe embodiments sharing various common elements and features with other embodiments, similar elements and features are given the same reference numerals and redundant description thereof may be omitted below.

Throughout the specification and claims, the following terms take at least the meanings explicitly associated herein, unless the context dictates otherwise. The meanings identified below do not necessarily limit the terms, but merely provide illustrative examples for the terms. The meaning of "a," "an," and "the" may include plural references, and the meaning of "in" may include "in" and "on." The phrase "in one embodiment," as used herein does not necessarily refer to the same embodiment, although it may.

The terms "controller," "control circuit" and "control circuitry" as used herein may refer to, be embodied by or otherwise included within a machine, such as a general purpose processor, a digital signal processor (DSP), an application specific integrated circuit (ASIC), a field programmable gate array (FPGA) or other programmable logic device, discrete gate or transistor logic, discrete hardware components, or any combination thereof designed and programmed to perform or cause the performance of the functions described herein. A general-purpose processor can be a microprocessor, but in the alternative, the processor can be a microcontroller, or state machine, combinations of the same, or the like. A processor can also be implemented as a combination of computing devices, e.g., a combination of a DSP and a microprocessor, a plurality of microprocessors, one or more microprocessors in conjunction with a DSP core, or any other such configuration.

Various illustrative logical blocks, modules, and algorithm steps described in connection with the embodiments disclosed herein can be implemented as electronic hardware, computer software, or combinations of both. To clearly illustrate this interchangeability of hardware and software, various illustrative components, blocks, modules, and steps have been described above generally in terms of their functionality. Whether such functionality is implemented as hardware or software depends upon the particular application and design constraints imposed on the overall system. The described functionality can be implemented in varying ways for each particular application, but such implementation decisions should not be interpreted as causing a departure from the scope of the disclosure.

The steps of a method, process, or algorithm described in connection with the embodiments disclosed herein can be embodied directly in hardware, in a software module executed by a processor, or in a combination of the two. A software module can reside in RAM memory, flash memory, ROM memory, EPROM memory, EEPROM memory, registers, hard disk, a removable disk, a CD-ROM, or any other form of computer-readable medium known in the art. An exemplary computer-readable medium can be coupled to the processor such that the processor can read information from, and write information to, the memory/storage medium. In the alternative, the medium can be integral to the processor. The processor and the medium can reside in an ASIC. The ASIC can reside in a user terminal. In the alternative, the processor and the medium can reside as discrete components in a user terminal.

Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

The term "communications network" as used herein with respect to data communication between two or more parties or otherwise between communications network interfaces associated with two or more parties may refer to any one of, or a combination of any two or more of, telecommunications networks (whether wired, wireless, cellular or the like), a global network such as the Internet, local networks, network links, Internet Service Providers (ISP's), and intermediate communication interfaces.

Figure 2:
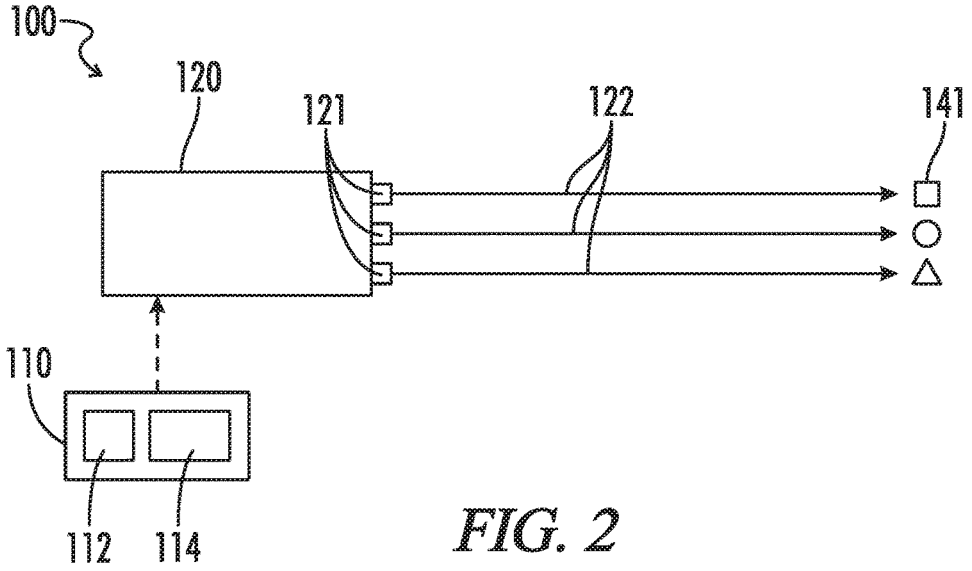
FIG. 2 is a diagram representing the embodiment of FIG. 1, with the devices configured with diffractive optical elements for shape projection.
Figure 10A:
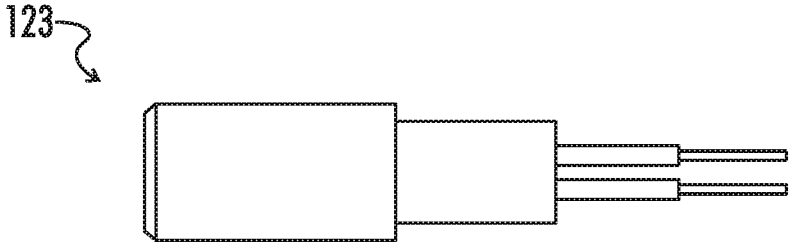
FIG. 10A is an isometric view of an exemplary laser emitter module according to the device of FIG. 3.
Figure 10B:
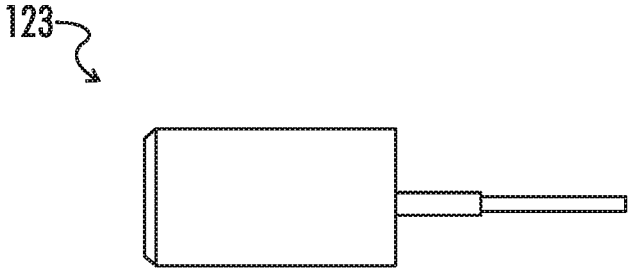
FIG. 10B is an isometric view of an exemplary laser emitter module according to the device of FIG. 3.

Referring initially to FIGS. 1 and 2, an embodiment of a system 100 as disclosed herein may include at least one device 120 configured to emit light signals 122 which project desired images on a specified target 140. The devices accordingly include at least one light source 123 such as for example a laser emitter housed within an apparatus 132 as represented for example in FIG. 7. The light sources may be multi-colored. Exemplary embodiments of the light source are shown in FIGS. 10A and 10B. The light source as shown in FIG. 10A being a model VLM-635-4.5 mW-BS laser produced by Infiniter and the light source as shown in FIG. 10B being a model VLM-520-4.5 mW-BS laser also produced by Infiniter.

The device of FIG. 1 projects laser dots via the light signals 122, which may for example be color-coded or optionally modulated in output (e.g., blinking, producing varying luminance) to activate visual motion detection in users. The light signals 122 may also be referred to herein as laser sources 122.

In some embodiments, the light signals 122 may produce projections using a traditional visible light and the specified target 140 may be any form of traditional impact surface for shooting upon which the light signal 122 can project. In certain optional embodiments, the light signals 122 may produce projections using non-visible and/or visible light (e.g., an infrared laser light, ultra-violet (UV) laser light, or the like) and the specified target 140 may include a specially coated reactive impact surface which is configured to react with the laser energy to display the object. This type of projection method uses a substance or surface luminescence reaction which displays the object in response to the light signal. The object may remain visible for at least a period of time after the laser is turned off and may gradually or quickly fade away once the light signal is removed. The specially coated reactive impact surface may utilize reversible or non-reversible photochromic or thermochromic response methodologies which react to the light signal 122 such as, for example, photoreactive paint, thermoactivated paint, or the like. This optional embodiment may have several advantages in certain settings, such as low light and bright daylight training settings as visible light can optionally be avoided. The optional embodiment, using temporary/reversible photochromic and thermochromic response of substances on target surfaces allows for the generation of "white light only" visible projections using invisible laser light. This embodiment creates a dynamic visual stimuli (using the same NURO system of DOE and low power laser) with projections that are either only visible with white light or only visible using night vision devices, or in certain embodiments using the right substance combination, visible with either white light or night vision devices but NOT visible un-aided to the naked eye with the ambient light present in the low-light training environment. The advantage to the photochromic and thermochromic application is that low-light aids, be it white light, IR-based night vision devices, or thermal night vision devices can all work to show the object, whereas the naked eye will not work. Accordingly, a value here is in forcing the student to practice using these low light tools.

Figure 11:
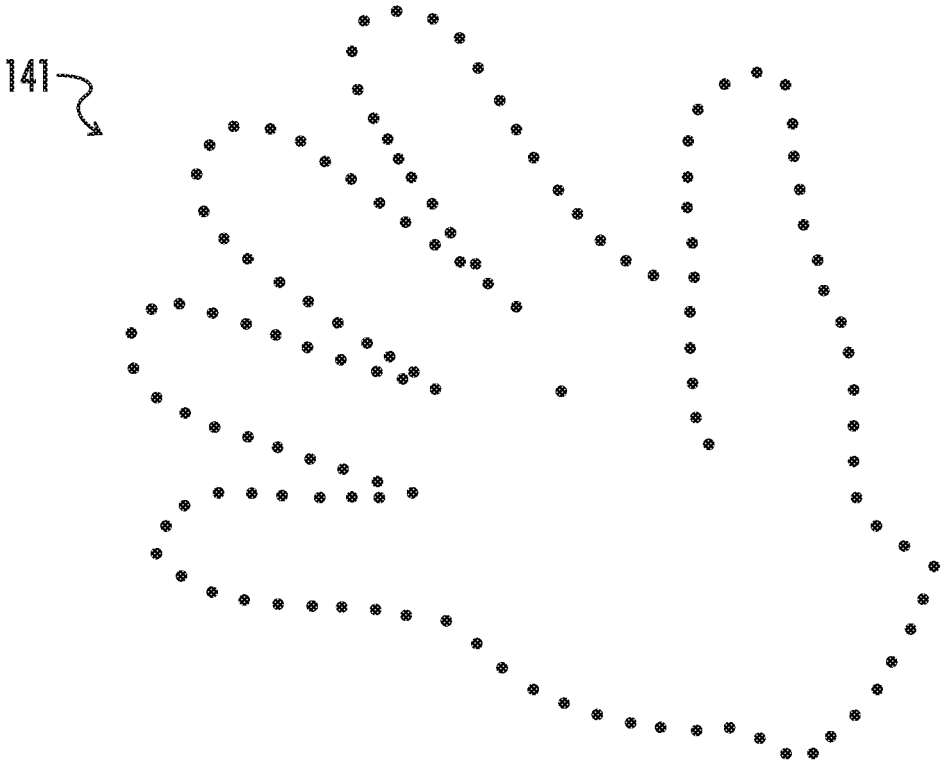
FIG. 11 is a diagram representing a shape projection generated by the device of FIG. 3.

The device of FIG. 2 further implements diffractive optical elements 121 (e.g., beam splitters) and may generate simple symmetrical or asymmetrical shape outlines 141 (e.g., triangles, squares, circles, guns, knives, bombs, badges, hands, silhouettes) via the emitted light signals 122, wherein object recognition components of the user's visual system are also stimulated. Referring to FIG. 11, an exemplary embodiment of a shape outline (namely a hand) generated using the DOE 121 is illustrated. The various shape outlines may also be generated with corresponding color-coded or modulated laser projection outputs. Programmed target stimulus arrangements may be implemented wherein a defined meaning is attributed to colors and shapes, or combinations of colors and shapes. A device including such diffractive optical elements can be used to stimulate partial object reconstruction neural circuitry and processing centers through, e.g., the partial blocking of projections at the source, the use of specially designed partial object projection DOEs, or even through the use of overlaid projections that confuse and/or interfere with each other, requiring the trainee's brain to sort the clutter and process the object(s) presented.

Generally stated, such systems in various embodiments as disclosed herein may provide administrative users (e.g., instructors) the ability to create dynamic extended reality environments where individual targets with controlled laser projections thereon (such target/dynamic projection combinations also being referred to herein as "subjects") have the ability to interact dynamically with both a subject-engaging (e.g., trainee) user and the environment. In this context, a subject or target is no longer simply defined using a static stimulus, such as a firearm or knife being stapled to it or painted on it, but the system as disclosed herein enables the generation and application previously displayed relevant stimuli, current stimuli, and future stimuli, all of which can be different.

In various embodiments, these stimuli can be pre-programmed on a time sequence, or manually manipulated by instructors, enabling low-cost "smart" targetry that actually interacts with trainees in real time. This ability to provide dynamic stimuli allows instructors to create environments where trainees must evaluate a subject and respond appropriately based on a totality of environmental factors as well as individual subject behavior.

Certain embodiments as further discussed below may further include software applications allowing remote instructor control of device projections as well as engagement assessment tools and accompanying processing software that will provide the ability for pre-programmed smart targetry that interacts with trainees based on their behavior or skill performance. For example, a determinative deadly force stimulus could be set to remain displayed until a defined number of rounds are fired with a defined standard of accuracy, or until a defined number of rounds are successfully fired into a "failure" area of a target/subject.

The device 120 of FIG. 1 or 2 may be generally characterized as portable, in that in various embodiments it is configured for selective mounting in a suitable location within a defined area containing the assigned targets, and arranged so that emitted light is directed to the targets or assigned areas thereof. The devices may preferably be detachable from a first given location and easily mounted in a second location as desired for a given training scenario.

Each device 120 may accordingly include a device controller configured to direct the projection of light from one or more of the laser sources according to a programmed target stimulus arrangement. The device controller may include circuitry mounted on a printed circuit board shared with some or all of the laser sources and other internal device components. In an embodiment, the programmed target stimulus arrangement may be fixed for a given device, but the device may also be enabled for selection from among multiple different arrangements. For example, the device may be provided with a manual interface for user selection at the device. The device may further include a network interface circuit or transceiver, such as for example a wireless communications module, for establishing or joining a communications network.

In various embodiments, an array of devices 120 as disclosed herein are (alone or considered as a networked array) entirely user programmable and controllable. While this functionality is not necessary for use of the device (the simplest operational mode requires only a single button user interface with no programming, as further described below), every output on the device can ultimately be controlled by the user and programmed into a virtually unlimited number of configurations. This specifically includes the ability to program an array of wirelessly networked devices to act in concert. Instructors can also manually control a device with tactile-based external buttons, either with single device or with multiple, wirelessly linked devices equating to low-cost and highly effective "smart" interactive targetry that creates a forensic record of the "actions" taken by the subject(s) and the timeline on which they occurred.

In another embodiment, a separate "master" controller 112 may be provided that may be communicatively linked to one or more of the devices 120 to facilitate complex training scenarios and/or settings. The master controller may for example be provided in association with a user computing device 110 (e.g., a smart phone, tablet, or dedicated control module) which further includes a display unit 114. The master controller in such an embodiment may preferably be capable of selecting, linking, and/or otherwise defining a group including one or more of the portable devices 120 in an area for a desired training scenario, and further capable of selecting or programming a target stimulus arrangement to be performed by the group of devices.

In a network of devices 120 as described above, commonly linked to a master controller 110 associated with the network, all data may generally be transmitted to and from the master controller. Networked devices may select (or have selected) and execute a programmed target stimulus arrangement via internal programming, or can be operated manually in a handheld setting (e.g., multiple instructors manually creating "smart" interactive targetry).

Figure 3:
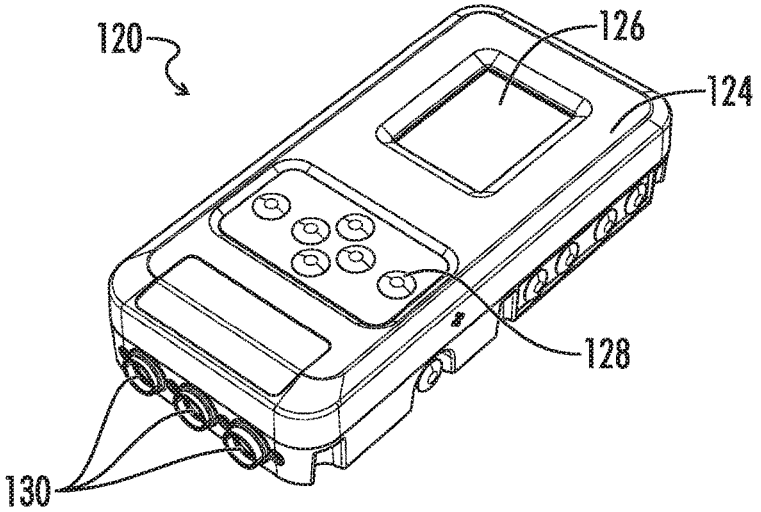
FIG. 3 is an isometric view of an exemplary portable device according the embodiment of FIG. 1.

As shown in FIG. 3, an exemplary portable device 120 as disclosed herein may comprise a housing 124 within which is disposed the aforementioned printed circuit board, laser sources, diffractive optical elements, and controller. The housing may preferably be designed for consistent use in harsh training conditions, and to be implemented both indoors and outdoors in virtually all seasons and weather conditions. In certain embodiments, the housing may comprise a weather-proof, UV-resistant outer shell and a robust, industrial-strength design that is intended to provide years of service in standard firearms training environments including heat, cold, sunlight, sweat, dust, and rain, where people are for example actually required to train for combat—not just carefully lit and climate-controlled training facilities.

The housing may include one or more apertures 130 corresponding to a defined light path for light emitted from the laser sources. An optional display unit 126 may for example enable displaying of a current target stimulus arrangement and/or device group, wherein one or more actuators such as buttons 128 may be implemented as a manual user interface for selection from among the various programmed target stimulus arrangements. The buttons and display unit may also be implemented to, e.g., select and/or display a unique identifier for the respective device that can be identified by master controllers in sufficient proximity.

Figure 7:
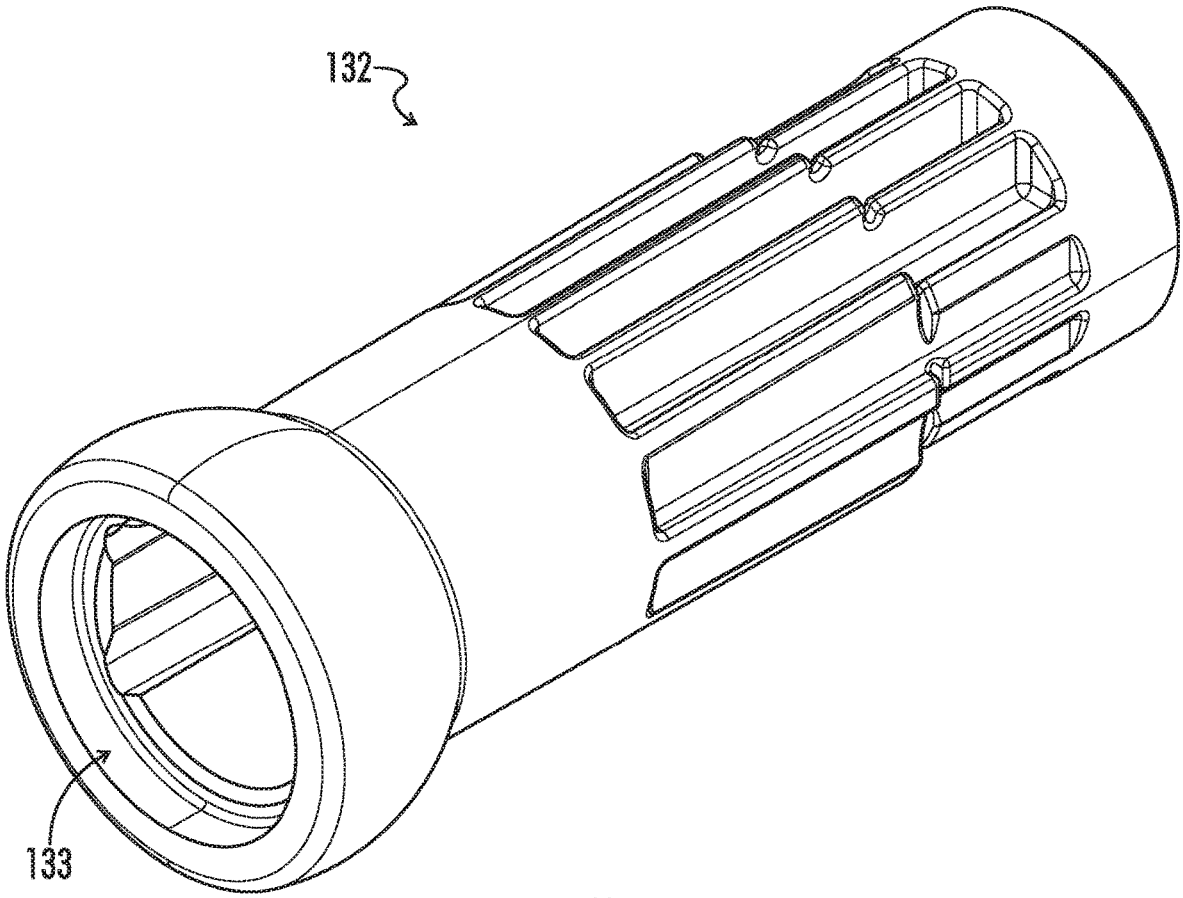
FIG. 7 is an isometric view of an exemplary laser emitter module housing according to the device of FIG. 3.
Figure 8A:
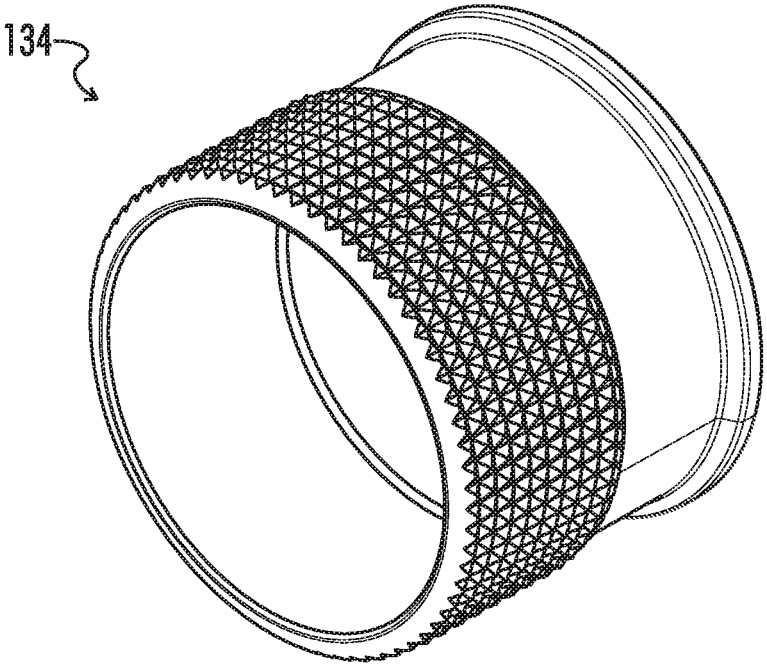
FIGS. 8A and 8B are isometric views of an exemplary diffractive optical element housing according to the device of FIG. 3.
Figure 8B:
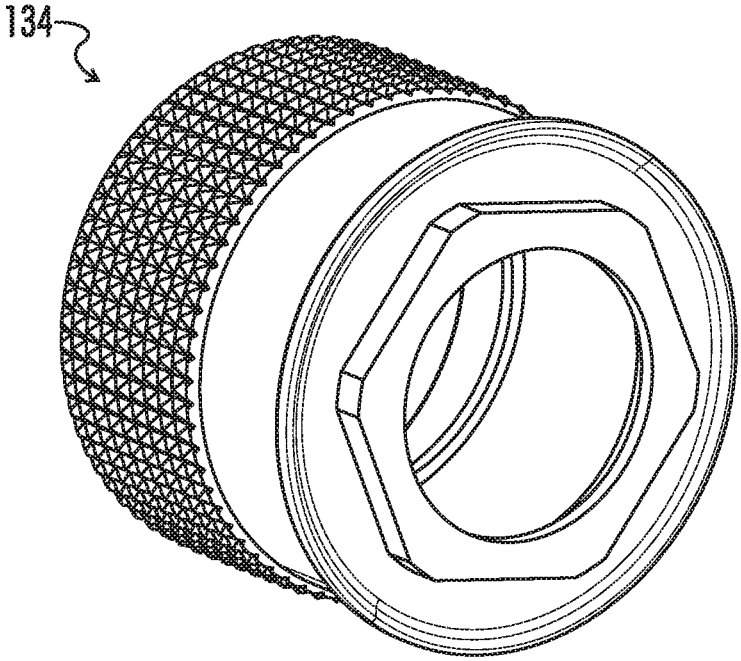

Each of the one or more apertures 130 may be configured to receive the apparatus 132 of FIG. 7. The apparatus includes an open end 133. Referring to FIGS. 8A and 8B, views of an example of a diffractive optical element (DOE) housing 134 are illustrated. The DOE housing is configured to be received by one of the open end of the apparatus 132 or one of the one or more apertures 130 of the portable device 120. The DOE housing is configured to receive the DOE 121.

Figure 9:
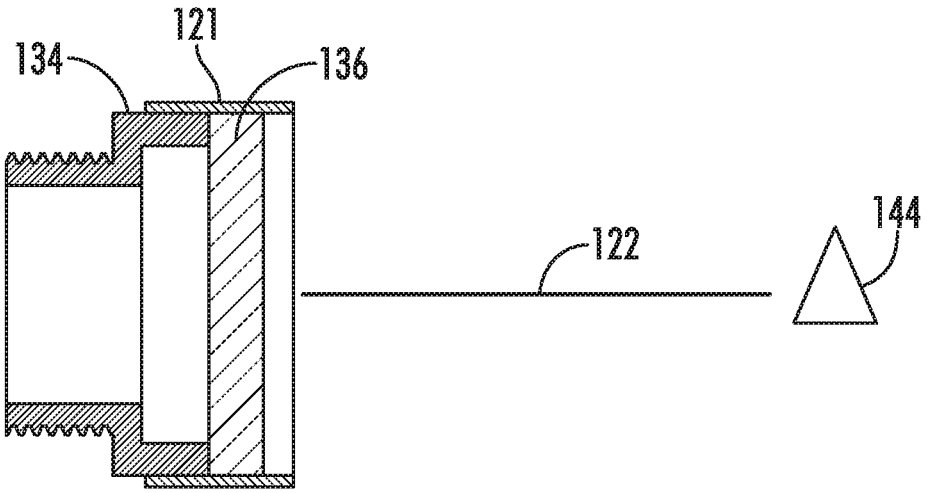
FIG. 9 is a cross-sectional diagram of an exemplary diffractive optical element according to the device of FIG. 3.

Referring to FIG. 9, the DOE 121 is shown in greater detail. The DOE housing 134 may be configured to receive a DOE lens 136. In certain optional embodiments, the DOE housing includes a rotating bezel. In additional optional embodiments, the DOE housing may include optimal performance information inscribed thereon (e.g., a visual indicator of the image to be projected, an optimal display distance, etc.).

Figure 4:
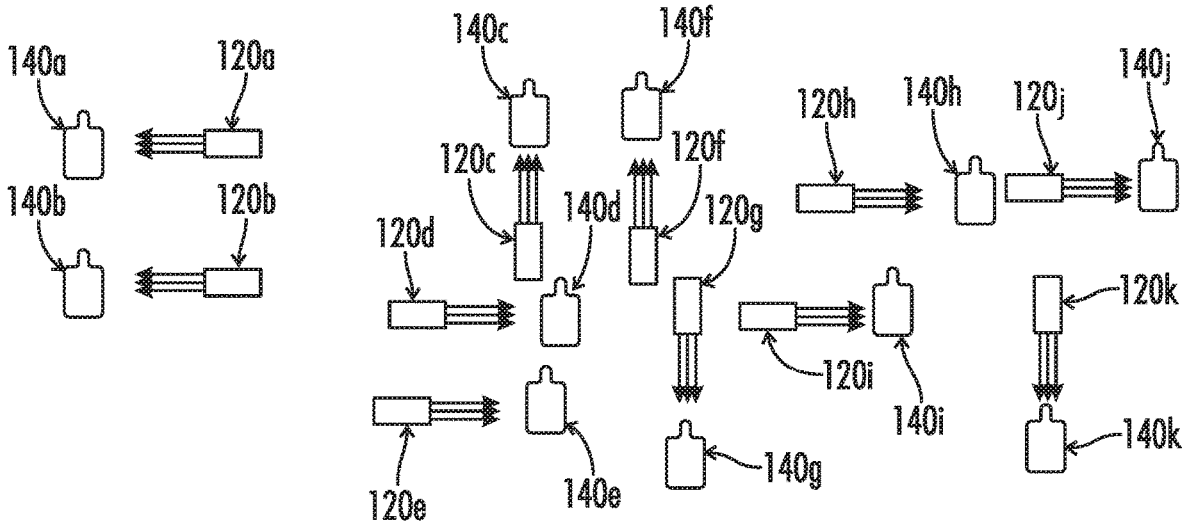
FIG. 4 is a diagram representing an exemplary implementation of multiple devices for image projection on respective targets, in accordance with the system of FIG. 1.
Figure 5:
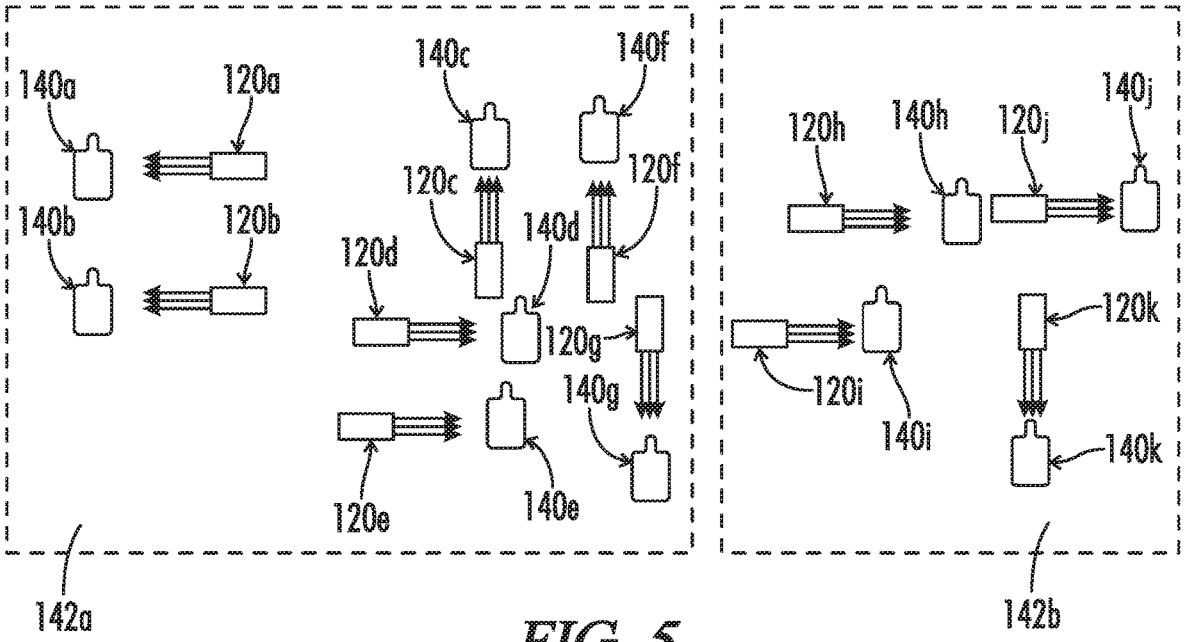
FIG. 5 is a diagram representing the exemplary implementation of FIG. 4, further having various arrays of devices assigned to respective groups for scenario generation.

Referring next to FIG. 4, an exemplary arrangement of devices 120 (e.g., 120*a*, 120*b*, etc.) and associated targets 140 (e.g., 140*a*, 140*b*, etc.) is illustrated for a defined area. As previously noted, each device may be individually programmed or actuated to generate a desired training scenario, or a group of devices may be collectively programmed or actuated. In FIG. 5, a first master controller 110*a* and a second master controller 110*b* are present in the defined area, wherein each controller has identified and effectively linked a plurality of the devices 120 to further define first and second groups 142*a* and 142*b*, respectively.

In one example, the master controller 110 may identify a plurality of available devices 120 in a defined area, responsive to a user-initiated query. The user may subsequently identify one or more of the available devices for implementation in a desired target projection scenario. Alternatively, the master controller may be responsive to user selection of a target projection setting having one or more required projection components, to automatically link to one or more of the plurality of available portable devices in association with the target projection setting. In certain contexts where a desired scenario requires one or more specific target projection components (e.g., mobile targets, specific projection shapes), the master controller may further identify available devices having the respective capabilities, and automatically select a group of such devices matching the user-selected or user-programmed scenario or enable manual selection by the user upon visually presenting the identified available devices for example in association with the matched capabilities/requirements.

Such embodiments, wherein a plurality of portable light projection devices is distributed about a defined area including a plurality of three-dimensional targets (and targets, three-dimensional or otherwise, as may be arranged in three-dimensional configurations), demonstrate another advantage with respect to conventional tools, including even the most advanced video projection training tools. Two-dimensional screen projections are inherently feature-based in nature and are very limited in their ability to stimulate spatial attention processing. Flat screens simply do not involve three-dimensional spatial arrangements and relationships, whereas systems and methods as disclosed herein facilitate addressing these contextual training system requirements. As previously noted, these consist of not only the broader situational context that impacts cognitive decision-making, but also the more fundamental contextual matters that impact unconscious sensory signal processing, to include scene layout and spatial attention. For example, a "one for one" projector to target ratio can be combined with networking functionality to create dynamic visual stimuli, which facilitates the application of cognitively-driven contextual processing during decision-making, and the simple, cost-effective creation of environments that are both multi-directional and three dimensional-thereby requiring use of the unconscious contextual processing functions related to scene layout.

One of skill in the art may further appreciate that most professional settings demand an empirical measurement (qualification) of skill performance. While not always required in non-professional settings, an inability to empirically measure performance limits an individual's ability to track and document progress in skillset development. This limitation often has a significantly negative impact on trainees' long-term skillsets and performance potential. Accordingly, various embodiments of a training system as disclosed herein, especially for applications implemented by armed professionals, may be configured to collect relevant data, and facilitate measurement, management, goal setting, and progress tracking. Importantly, such embodiments may facilitate potential performance evaluations (qualification) involving measurement (after training) of the performance capability of the same physical, neurological and physiological mechanisms that are involved in job performance, at scale and in a cost-effective manner. Traditional methods of visual stimulus projection (and complex scenario generation) do not provide deterministic stimuli indicating the necessity for skill performance, and therefore do not possess the capability of empirically measuring such performance. In contrast, a system as disclosed herein generates a dynamic (i.e., both appearing and disappearing), deterministic, and determinative stimulus, thereby facilitating empirical measurement of performance, to include decision-making, initiation, and cessation of skill performance (de-escalation of force).

Figure 6:
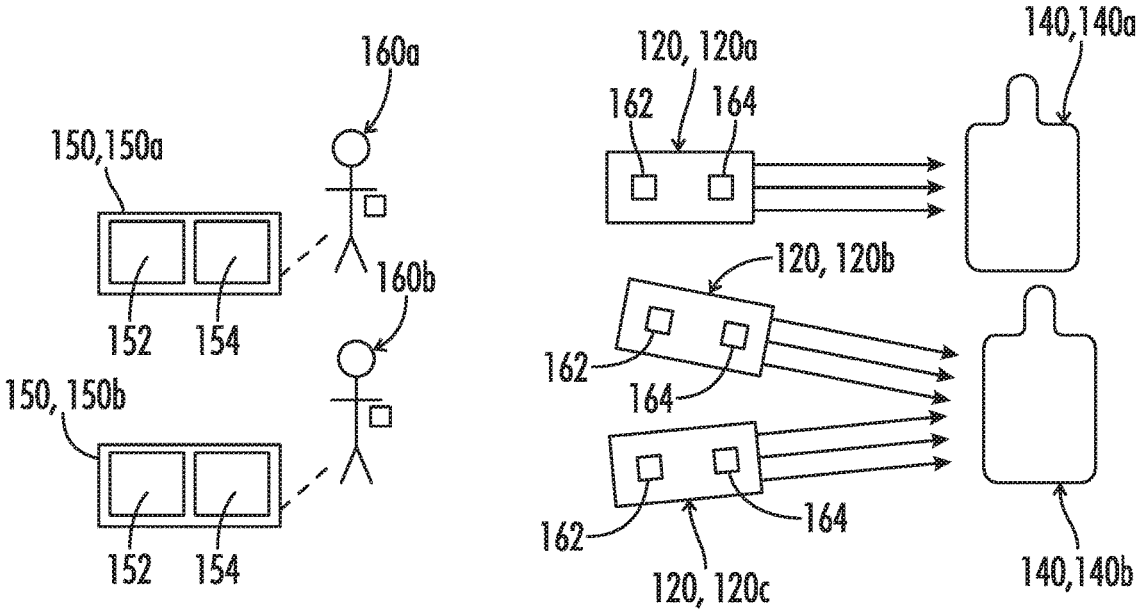
FIG. 6 is a diagram representing the exemplary implementation of FIG. 4, further having sensor arrays for shooter isolation.

Referring next to FIG. 6, in an embodiment an array of sensors 150 may optionally further be provided in association with a given user for shooter isolation in the context of a selected training scenario. For example, the sensor array may be implemented such that only shots by a specified shooter are identified and recorded by an associated device with respect to a training scenario for use in public ranges and qualification settings. A sensor array may be provided in a single housing or may be distributed in nature, and may for example include an accelerometer 152 and an audio input module 154 such as may include a microphone. The sensor array may for example be mounted to the wrist or arm of a user, to the firearm in use, or otherwise in a manner readily associated with the user during performance for isolation purposes, and implementation of both the accelerometer and a microphone may effectively reduce false positive determinations through the dual-input configuration.

As illustrated in FIG. 6, a first sensor 150*a* may be associated with a first shooter 160*a* and a second sensor 150*b* may be associated with a second shooter 160*b*. The first shooter 160*a* may be shooting at a first target 140*a* associated with a first device 120*a*. The second shooter 160*b* may be shooting at a second target 140*b* associated with an arrangement of devices 120 (e.g., a first device 120*a* and a second device 120*b*).

One or more audio output modules may also be provided, capable of providing for example a buzzer, siren, verbal commands, or other suitable audible stimuli to a user in training environments, which can be set for a variety of patterns and timeframes and even for example during live fire settings. Accordingly, the above-referenced projection schema and the networkability of the platform not only facilitates the creation of device arrays (or multiple device arrays), wherein instructors can easily use the platform to create actual background scene layout, but this capability further includes combining dynamic visual stimuli and dynamic audible stimuli.

One or more of the aforementioned sensors may be provided in the portable devices instead of, or in addition to, the sensor housing. In an embodiment, each device 120 includes the audio output modules 162 and device controllers 164 networked thereto may be configured to direct the projection of light from one or more of the one or more laser sources and of audible signals from the audio outputs according to the programmed target stimulus arrangement. In another and potentially more complex example, integrated system modules including speakers may be mounted at individual target stations to provide the directional stimuli as well as the desired content stimuli, as may be controllable via commands from a master controller for a given target stimulus arrangement.

Because various embodiments of a system as disclosed herein are based on distributed and networked modules associated with each "subject" or target, rather on a centralized projection component, such systems provide instructors the capability of creating truly three-dimensional environments, thereby generating spatial-awareness-related signal processing in trainees. The above-referenced optional capability to provide unique audio output with every device, through use of, for example, a programmable buzzer, allows instructors and individuals to easily create environments that are both visually and audibly dynamic in three-dimensional configurations.

In an embodiment, the master controller may be configured to determine user performance at least partially by receiving shooting feedback, shot splits, etc., and tying a trainee's physical actions directly to specific audio outputs and dynamic visual stimuli (e.g., controlled optically projected light against 2D or 3D targets in a defined area) according to the programmed target stimulus arrangement, for example with audio inputs corresponding to a particular firearm. Specific stimuli and combinations of stimuli can be created and tracked forensically as discreet events in a timeline, including audible stimuli generated by a specific projection device. Therefore, since specific stimuli can be predictably produced and forensically documented, the ability of the trainee to recognize a specific stimulus (and the neurological functions necessary to do so) can be both exercised and empirically measured. This facilitates the development of consistent, definable, and empirical standards of performance when combined with defined standards of accuracy, and without a requirement to develop or produce defined or consistent sets of stimuli or a consistent course of fire. This further may effectively eliminate the unintended negative effects of current measurement methods, wherein for example armed professionals become accustomed to performing defined skill sequences without the involvement of stimulus receipt or evaluation, ongoing information processing, or decision-making.

In an embodiment, a system as disclosed herein can be configured for empirical measurement not only of responses by the user to determinative stimuli as events recorded in a timeline, but also of the firearms-based use of force skill application, including response times for escalation and de-escalation of force in a scalable platform that is suitable for institutional qualification use. Application of force can be prioritized based on the environment, terrain, and threat action/behavior via a combination of visual and audible stimuli.

In an embodiment, the system is capable of empirically measuring and tracking a trainee's response times, both for applying deadly force and for ceasing to apply deadly force in response to visual stimuli, not just within an individual scenario but also, using data tracking and analysis tools, throughout an individual's entire operational lifecycle if desired.

One of skill in the art may appreciate that various environmental considerations (e.g., noise, weather) can make it difficult for instructors or individual shooters to capture data for analysis and tracking. To help address these concerns, embodiments of a system as disclosed herein may be configured for the optional storage of user performance data during training while in both single device and array modes. This data can either be recalled on the device itself or downloaded later to a computer for easier analysis and application. For example, a tablet-based application may be implemented for qualification use, where all relevant data (including shooter identification and accuracy/shooting scores) can be stored directly on the tablet or uploaded to a cloud-based system. When set up by the user, all relevant information (as defined by the user) from each device or array will be automatically transferred to the user's medium of choice for long-term storage and/or analysis.

The master controller may further preferably be configured to dynamically modify the programmed target stimulus arrangement upon comparing the determined user performance with one or more target parameters associated with the user performance. For example, the system may assign difficulty levels to different target stimulus arrangements, wherein a particular arrangement can be selected before (or perhaps during) a given training scenario based on the determined performance of the user. As another example, the system may track the user's movements as well as shooting performance, and accordingly modify the locations and/or sequence of subjects to be engaged by the user during a given scenario.

In an embodiment, the placement of projections in relation to a target-engaging user (e.g., trainee) may be varied by an administrative user (e.g., instructors) to effectively stimulate both central and peripheral vision. System-integrated mobile target platforms may further be implemented for stimulating blindsight sensory functions.

In an embodiment, the display unit of the master controller may further be configured as a user interface which displays indicia corresponding to the determined user performance, and also further enables user selection of one or more modifications to the programmed target stimulus arrangement based on the determined user performance. For example, the user may elect to repeat or skip certain portions or aspects of a programmed target stimulus arrangement, or to cause the arrangement to be sped up or slowed down, etc.

Although several of the above-referenced functions are described with respect to a master controller, in various embodiments of the invention it may be contemplated that a separate server or computing device may be configured to perform certain functions as part of a distributed performance qualification system. For example, a server may be linked to each of a plurality of master controllers associated with a defined area or with specific users, wherein the server receives data from the master controllers corresponding to a specific training scenario, the devices and targets involved, and an identity of the shooter, and the server further receives and aggregates feedback from the various data sources for user performance determination. The server may transmit user performance data to a master controller or other local devices for subsequent analysis or even intervention in real time such as dynamic user modification of the training scenario. The server may further merely direct the user performance data to be stored and potentially aggregated with respect to the user, the location, or various other parameters as may be useful for downstream analysis and potentially future generation of training scenarios.

An embodiment of a system and method as disclosed herein enables remote instructor control of targetry via, e.g., an associated computing device such as a tablet which may be linked to the above-referenced server for interactive "smart" targetry in team settings. Where the system implements body- or weapon-mounted sensor arrays to isolate individual shooter performance, the empirical assessment of individual shooter skill performance may also be facilitated in team-based tactical settings.

As previously noted, various versions and/or difficulty levels of programmable target stimulus arrangements may be available, or even user-determinable in dynamic fashion. In various embodiments a hosted web-based or equivalent application may interface with user computing devices to enable transactions including the selection and downloading of arrangements, including new pre-developed scenarios/programs (along with expected performance data and training aids) for a variety of different training applications and user needs.

At a relatively basic level, an embodiment of a single projection device as disclosed herein can function as a highly reliable (and weather resistant) shot timer with either audible or visual stimuli, including the capacity for setting simple par sets. It also may be provided with an individual training mode, consisting of "hard-wired" scenarios where a single button push is the only user interface required to provide random visual stimuli equating to skill building and tactical scenarios. It can also be used for example as an entry level training tool for instructors to manually generate variable visual stimuli for students.

The previous detailed description has been provided for the purposes of illustration and description. Although there have been described particular embodiments of a new and useful invention, it is not intended that such references be construed as limitations upon the scope of this invention except as set forth in the following claims.

What is claimed is:

1. A firearm training system for selectively generating images onto external target elements, comprising:

one or more specified target elements each having impact surfaces at least partially coated with a photochromic or thermochromic substance;

one or more portable devices selectively mounted with respect to selected ones of the external target elements, each comprising:

a housing accommodating and configured for optical projection of non-visible light from one or more laser sources and one or more diffractive optical elements, one or more audio outputs, and a device controller configured to direct a projection of light from one or more of the one or more laser sources, and further to direct audible signals from the one or more audio outputs, according to a programmed target stimulus arrangement, wherein the at least partially coated impact surfaces of the one or more specified target elements are configured to undergo one or more of a photochromic reaction and a thermochromic reaction with the projected light to display the programmed target stimulus.

2. The firearm training system of claim 1, further comprising:

a master controller communicatively linked to the one or more portable devices, and configured to transmit the programmed target stimulus arrangement thereto.

3. The firearm training system of claim 2, wherein:

the one or more portable devices comprise a plurality of portable devices in a defined array, each of the plurality of portable devices identified as a component of the programmed target stimulus arrangement and configured to direct the projection of light accordingly.

4. The firearm training system of claim 2, wherein:

the master controller is configured to selectively link to one or more of a plurality of portable devices associated with a defined target area, and to further selectively transmit the programmed target stimulus arrangement to the linked portable devices.

5. The firearm training system of claim 4, wherein:

the master controller is configured, responsive to user selection of a target projection setting having one or more required projection components, to link to one or more available portable devices of the plurality of portable devices in association with the target projection setting.

6. The firearm training system of claim 4, wherein:

the master controller is configured to identify one or more available portable devices of the plurality of portable devices, and to further select one or more of the available portable devices based at least in part on required projection components of the programmed target stimulus arrangement.

7. The firearm training system of claim 1, further comprising:

one or more sensors each having a microphone and an accelerometer and communicatively linked to the master controller, wherein the master controller is configured to determine user performance at least partially by correlating audio outputs and optically projected light according to the programmed target stimulus arrangement with at least one of audio inputs or accelerometer inputs corresponding to a particular firearm.

8. The firearm training system of claim 7, wherein:

the master controller is configured to dynamically modify the programmed target stimulus arrangement upon comparing the determined user performance with one or more target parameters associated with the user performance.

9. The firearm training system of claim 7, wherein:

the master controller comprises a user interface configured to display indicia corresponding to the determined user performance, and further configured to enable user selection of one or more modifications to the programmed target stimulus arrangement based on the determined user performance.

* * * * *